United States Patent [19]

Kobori et al.

[11] Patent Number: 4,761,241

[45] Date of Patent: Aug. 2, 1988

[54] OILY LUBRICANT FOR COLD PLASTIC PROCESSING OF METALLIC MATERIAL

[75] Inventors: Takeshi Kobori; Shigeki Kimura, both of Yokohama, Japan

[73] Assignee: Nihon Kousakuyu Co., Ltd., Tokyo, Japan

[21] Appl. No.: 894,660

[22] Filed: Aug. 8, 1986

[30] Foreign Application Priority Data

Apr. 14, 1986 [JP] Japan ..... 61-85652

[51] Int. Cl.[4] ..... C10M 137/06

[52] U.S. Cl. ..... 252/32.5; 252/49.8; 252/515 R; 252/56 R; 252/56 S

[58] Field of Search ..... 252/56 R, 49.5, 51.5 R, 252/52 A, 49.6, 32.5, 56 S, 49.8; 72/42

[56] References Cited

U.S. PATENT DOCUMENTS

| | | | |
|---|---|---|---|
| 2,486,493 | 11/1949 | Revukas | 252/56 R |
| 2,508,016 | 3/1950 | Doyle et al. | 252/56 R |
| 2,544,376 | 3/1951 | Buther | 252/56 R |
| 2,604,453 | 7/1952 | Popkin | 252/56 R |
| 2,899,390 | 8/1959 | Plemich | 252/56 R |
| 3,223,635 | 12/1965 | Dwyer et al. | 252/56 R |
| 3,340,194 | 9/1967 | Rue et al. | 252/56 R |
| 3,429,815 | 2/1969 | Drake | 252/56 R |
| 4,585,564 | 4/1986 | Tohmata et al. | 252/56 R |
| 4,600,547 | 7/1986 | Beckwith et al. | 252/56 R |

FOREIGN PATENT DOCUMENTS

| | | | |
|---|---|---|---|
| 57-137390 | 8/1982 | Japan | 252/56 R |

*Primary Examiner*—William R. Dixon, Jr.
*Assistant Examiner*—Margaret B. Medley
*Attorney, Agent, or Firm*—Koda and Androlia

[57] ABSTRACT

An oil lubricant for cold plastic processing of metallic material obtained by compounding either one or both types of polymers of 2-ethyl polyacrylate-hexyl ester and polymethacrylic acid lauryl ester with one or two types of oiliness improvers selected from the group consisting of refined lard, oleic acid, phosphate, hindered ester, isostearic acid, and $C_{18}$ saturated higher alcohol and which are liquid at room temperature and which are compatible with the polymers. The oiliness improver is compounded as a thinning oil at a specified composition ratio.

1 Claim, No Drawings

OILY LUBRICANT FOR COLD PLASTIC PROCESSING OF METALLIC MATERIAL

BACKGROUND OF THE INVENTION

1. Field of the Invention

The present invention relates to an oily lubricant for cold plastic processing of metallic material, and particularly to an oily lubricant used for cold plastic processing, such as drawing, contraction of area, and forging of metallic material.

2. Prior Art

For cold plastic processing, such as drawing, reduction in area (drawing), and forging, of metallic material, various forms of lubricants are added in order to prevent frictional damage (burning) of the metal mold, die. etc. and the material to be processed, such as steel pipe and steel sheet, and to improve the quality of the processed product as well as to deter the wear of the tools.

In conventional drawings oils and press oils as the oily lubricants, mineral oils or synthetic lubricating oils are used as the base oil, with oiliness improvers and extreme pressure additives added to them. However, they are low in burning resistance; and when the draft becomes high in degree and the contact area between the material to be processed and the tool is increased, they tend to cause film breakage with resulting burning. Thus, they have been applicable only to relatively light degree processing (for example, sinking), and it has been totally unfeasible to use them for steel pipe drawing, etc. under the severe processing conditions. Also, since they contain the extreme pressure additives, metal corrosion is caused.

In conventional oily lubricants, for the synthetic lubricating oil as the base oil, polybutene, $\alpha$-olefin, oligomer, polyethyleneglycol, etc. are used, and for the oiliness improver, fats and oils, saturated and unsaturated fatty acids with 10 or more carbons, fatty acid esters, phosphate, alcohol, etc. are used, and also, for the extreme pressure additive, chemical compounds containing sulfur or chlorine are used, respectively.

The base oil is a carrier that has the function of dissolving the oily lubricant and the extreme pressure additive homogeneously and stably and to feed them into the portions needing to be lubricated. Mineral oils and synthetic lubricating oils do not have strong polar groups and they are low in lubricating ability. Accordingly, they cannot be used as the lubricant by themselves, but chemical changes such as oxidation and deterioration are caused less to them, and because of that reason, they are used as the base oil.

The oiliness improver is the stuff that is fed by the base oil to the friction surface of metal needing the lubrication, and to cause the lubricating effect by being adsorbed. Fats and oils, fatty acids, etc. are long chain compounds with heavy molecular weight, and they have a strong polar group at one end of molecule. By the action of that polar group, their molecules are strongly adsorbed to and configured along the metal surface, thereby forming the adsorption film. Furthermore, because of the mutual attraction between the long molecular chains configured to make the adsorption film, the film becomes firm and strong, and shows the lubricating effect (to reduce the friction). However, as the temperature goes up, the configuration of molecules become disordered, and at about 150° C., the film separates, and the lubricating effect is lost. Since the oiliness improver loses its lubricating effect when the temperature reaches 150° C. or above, the adding of the oiliness improver under severe lubricating conditions is not effective. Consequently, an extreme pressure additive that shows the lubricating effect at high temperature is added.

The extreme pressure additive is the stuff that is supplied, same as the oiliness improver, to the metal's friction surface needing the lubrication, by the base oil, and forms the film on the metal surface, by chemically reacting with the metal when the degree of plastic processing becomes high and the contact area between the material to be processed and the tool becomes increased with the resulting extreme pressure condition which accompanies high temperature and high pressure. Through, the formation of the film mentioned above, the extreme pressure additive prevents the burning by reducing the friction, and improves the burning resistance of the lubricant. Chemical compounds containing chlorine or sulfur are different in reaction temperature range, respectively. Therefore, they are added in accordance with their purpose and use, when used together with the base oil and the oiliness improver. For the extreme pressure additive containing chlorine, chlorinated paraffin is used in many cases, and at 150° C. to 250° C., the C—Cl bond is cut off due to thermal decomposition, and $Cl_2$ or HCl is formed. Thus, the extreme pressure lubricating effect is shown. However, such extreme pressure additive has a disadvantage that, when water is present, hydrolysis is caused, and HCL is liberated, thereby causing serious corrosiveness. The boundary lubrication temperature range of the sulfur compounds is about 250° C. to 350° C.

Also, as the conventional oily lubricants, there are those containing, in addition to the abovementioned three types of components, solid lubricants, such as graphite and molybdenum disulfide are mixed in them in order to improve the burning resistance. However, such oily lubricants tend to cause the burning, and the same as the other oily lubricants, they can be used only for the relatively low degree processing work (for example, sinking). Besides, such oily lubricants have problems including that the oil supply becomes difficult because of the presence of the solid lubricating agent, that they accumulate in the metal mold, or that they worsen the maintenance.

As has been described above, in the use of the oily lubricant, by means of the base oil, the oiliness improver and the extreme pressure additive are supplied to the friction surface of metal and adsorbed there. Then, in the temperature range from room temperature to about 150° C., as the fluid lubrication range in which the oiliness improver serves to maintain the oil film, the oiliness improver shows the lubricating effect; while in the boundary lubrication range with higher temperature and with severe processing condition, the extreme pressure additive functions to maintain the oil film and shows the lubricating effect. However, as to the degree of the actual lubricating effect of the oily lubricant, because of the low burning resistance, it is only high enough for low degree plastic processing for steel pipe drawing, etc.

However, the oily lubricant can be used by merely supplying it to the surface of metal to be processed. Therefore, the process is simple and also it is quite easy to remove it after the processing.

Accordingly, various methods for improving the burning resistance of the lubricant as mentioned below have been employed conventionally.

For example, for cold drawing of steel pipe, the following methods have been used.

a. The steel pipe is treated with chemical conversion coating (for example, phosphate coating, oxalic acid oxidation coating) in advance, and also, provided with secondary lubricant (for example, metallic soap, such as sodium stearate, and oil).

b. The steel pipe is coated with a liquid form synthetic resin (liquid obtained by emulsifying a synthetic resin, or by dissolving the synthetic resin in a solvent) in advance, and the coating is solidified by drying.

Also, for the drawing of the sheet form metallic material, the methods as mentioned below have been used.

c. The lubrication film is thickened by directly coating the material with press oil that is specifically made high is viscosity.

d. Press oil with extreme pressure additive added to it is used for directly coating the material with it.

e. After coating the material with a solution of synthetic resin, such as vinyl chloride resin, hardening by drying is carried out.

f. The synthetic resin film is directly adhered to the surface of material to be processed.

However, these methods are not satisfactory in terms of simplicity in lubricating treatment, readiness for removal after processing, and the clearness of the metal surface. Practically speaking:

The method a. mentioned above enables the lubricant to show sufficient lubricating effect even when the degree of processing (draft) is high. However, because the lubricant is of the chemical reaction type, it is troublesome to control the processing solution; and also because the life of the lubricant is short, it is necessary to carry out waste solution disposal treatment frequently. Thus, this method has an economic problem, and at the same time, it may become the cause of the environmental pollution. Besides, since the lubrication film adheres too well, it is difficult to remove the film from the product after the processing. Furthermore, since the processing is of the chemical reaction type and if the material is highly anticorrosive, the chemical treatment itself is hard to carry out, and the homogenous chemical conversion coatings cannot be formed.

The method b. is to physically adhere the film over the surface of the metallic material, and a lubricant having lubricating characteristics superior to those obtained by the method a. are developed. However, it has a disadvantage in that it requires extensive drying to obtain the lubrication film. The removal of the film after the processing becomes more difficult as the lubrication film becomes stronger.

The method c. is defective in that the processability becomes lower with increase in viscosity; and the method d. is disadvantageous in that, since it uses a somewhat restrained corrosion reaction, severe corrosiveness is caused by the presence of water, etc.

The methods e. and f. make it possible to perform drawing of a high degree in draft and deep drawing which are not achievable by the drawing oil and press oil. However, they have the shortcomings in that they require strenuous work for drying and adhesion of the resin film, and also in that they are considerably higher in cost in comparison with the drawing oil and the press oil.

As has been mentioned above, while conventional lubricants have characteristic effects, respectively, every one of them has some problems.

SUMMARY OF THE INVENTION

The present invention is intended to solve the above-mentioned problems in the prior art, and the object of this invention is to provide an oily lubricant for cold plastic processing of metallic material, that has a burning resistance nearly equivalent to that of lubricants obtained by the conventional chemical conversion coatings or synthetic film coatings, for the range from the fluid lubrication range to the boundary lubrication range.

Another object of this invention is to provide an oily lubricant for cold plastic processing of metallic material that does not cause corrosion to the metallic material.

The foregoing objects of this invention are achieved by composing the oily lubricant for cold plastic processing of metallic material according to this invention as described below.

In the polymers of either of or both of 2-ethyl polyacrylate-hexyl ester and methacrylic acid lauryl ester one type or not less than two types of oiliness improvers which are a liquid at room temperature and also which are compatible with the foregoing polymers are compounded as the thinner oil in a specified ratio. Since the oiliness improvers are liquid at room temperature and are compatible with the polymers mentioned above, there are, for example, refined lard, oleic acid, phosphate, hindered ester, isostearic acid, and $C_{18}$ saturated higher alcohol.

DETAILED DESCRIPTION OF THE INVENTION

Hereunder, a detailed description of the process for determining that which has been mentioned above as the principles of this invention will be given.

The inventors of this invention embarked on a study of an oily lubricant that is lowest in burning resistance among those applied in the various types of lubrication processing methods, but that is able to simplify the process and is high in readiness for its removal after the processing, in order to eliminate the corrosiveness to metals from it, and to provide it with a burning resistance comparable to the oily lubricant obtained by the conventional chemical conversion treatment or coating treatment, thereby making it feasible to actually apply it to the drawing of steel pipes.

First, the inventors decided to recheck the defective points of the conventional oily lubricants.

(1) The corrosiveness to metals is derived from the extreme pressure additive contained in the oily lubricant; and as far as the extreme pressure additive is concerned, the corrosiveness to metals is unavoidable.

(2) Mineral oils and synthetic lubricating oils used as the base oil are chemically stable at high temperatures and under high pressure, but they are extremely low in burning resistance. Because of the above, the oiliness improver and the extreme pressure additive are added.

Based on the above-mentioned understandings, the inventors started to find out, from high molecular compounds, a substance that is chemically stable (non-reactive), and that shows a far higher burning resistance (degree of oil film strength) than that shown by the conventional ones, even in the boundary lubrication range (high temperature, high pressure), without using an extreme pressure additive.

The inventors expected that, of the high molecular compounds (polymers), those with markedly heavy molecular weight are high in chemical stability and suitable as the base oil, and also that some of them are high in burning resistance. Accordingly, it was decided that, from innumerable high molecular compounds, those which are not needed to be dissolved (those which are not in the form of a paste, powder, grain, or lump at room temperature) were to be selected. As a result, as the substances which are liquid at room temperature, four types, that is, (1) polybutene, (2) copolymer of ehtylene and α-olefin, (3) polybutadiene, and (4) butyl polyacrylic ester were found. Then, by investigating their physical properties (average molecular weight and viscosity), the results shown in Table 1 were obtained. Following it, for these four types of substances, a drawing test and a Bauden test as the evaluation method for the lubrication characteristics were carried out, and the results shown in Tables 2 and 3 were obtained. For the Bauden test, each sample agent was coated over the surface of the stainless steel (SUS 304), the test temperature was maintained at 100° C., a steel ball of 3/16′ in diameter was pressed onto the coated surface with a 2 kg load, and it was made to reciprocate at 0.8 mm/sec in speed. Under the foregoing conditions, the variation in the coefficient of friction of the sample agent was checked. Then, the coefficient of friction $\mu$ at the initial time and the number of times of frictions reaching to $\mu=0.2$ were evaluated as the burning resistance.

TABLE 1

(Physical Property)

| Sample Agent Tested | Average Molecular Weight (Mw) | Viscosity 100° C. (cp) |
|---|---|---|
| 1 | 2,350 | 4,000 |
| 2 | 3,600 | 2,000 |
| 3 | 2,800 | 360 |
| 4 | 17,000 | 580 |

TABLE 2

(Bauden Test)

| | Coefficient of Friction $\mu$ | Number of Times of Frictions until Reaching to $\mu = 0.2$ |
|---|---|---|
| 1 | 0.198 | 7 |
| 2 | Higher than 0.2 | 0 |
| 3 | 0.168 | 10 |
| 4 | 0.160 | Not less than 100 |

TABLE 3

(Drawing Test)

| | | 1 | 2 | 3 | 4 |
|---|---|---|---|---|---|
| State of Pipe | Internal Surface | X | ○ | X | ⊙ |
| | External Surface | Δ | ○ | Δ | ⊙ |
| State of Plug | | XX | ○ | X | ⊙ |
| Drawing Load (ton) | | 7.1 | 7.5 | 7.3 | 6.9 |

TABLE 3-continued (Drawing Test)

| | 1 | 2 | 3 | 4 |
|---|---|---|---|---|
| Plug Thrust (ton) | 1.6 | 1.4 | 1.4 | 1.2 |

Remarks:
1. Evaluation of the state of pipe
XX . . . Burning is extensive.
X . . . Slightly burnt.
Δ . . . Metallic luster and streak due to oil film breakage are observed.
. . . Slight streak.
⊙. . . No abnormality is observed.
2. State of plug
XX . . . Burning is extensive.
X . . . Slightly burnt.
○ . . . Cloudiness is observed.
⊙. . . No abnormality is observed.
3. Drawing load . . . Indicated with maximum drawing load (gross drawing load).
4. Plug thrust . . . Indicated with maximum plug thrust.
5. Tested under the drawing condition IV in Table 13.

In Table 2, the friction coefficient $\mu$ of (4) is 0.160, and this is considerably smaller than the general maximum threshold value of 0.2 suitable for the lubricant. Also, the number of times of friction until the friction coefficient $\mu$ exceeds 0.2 is remarkably large (100 or above). Also in Table 3, (4) shows a noticeably high value for the drawing test.

Therefore, it was decided that, of the tested agents (1) through (4), butyl polyacrylic ester of (4) alone was preferable.

Thus, the inventors predicted that high molecular compounds having a molecular structure similar to that of butyl polyacrylic ester would be high in lubricating performance, and looked for ones which are in a liquid state at room temperature, out of the polyacrylic acids, polymethacrylic acis, and copolymers of acrylic acid esters and methacrylic acid esters.

Because polyacrylic acids are low in Tg (glass transistion temperature), although it depends on the number of carbons in the ester portion, many of them are in a liquid state at room temperature.

In general, polymethacrylic acids are high in Tg. Accordingly, many of them are in powder form or solid state at room temperature. Of such methacrylic acids, those found to be in a liquid state at room temperature were polymethacrylic and lauryl ester and 2-ethyl polymethcrylate-hexyl ester.

Since the copolymers of acrylic acid ester and methacrylic acid ester are either excessively viscous or in a solid state at room temperature, they were excluded by deciding that they are not suitable for the purpose of obtaining the liquid lubricant.

Table 4 shows the physical properties (average molecular weight and viscosity) of the selected high molecular compounds. Tables 5 and 6 show the results obtained for the drawing test conducted with regard to the burning resistance.

As shown in Tables 5 and 6, every one of the high molecular compounds selected as shown in Table 4 was better than commercial products in results. Those showing particularly good results were (7) and (9).

TABLE 4

| No. | Sample Agent Tested | Average Molecular Weight (Mw) | Viscosity 100° C. (cp) |
|---|---|---|---|
| 4 | Butyl polyacrylate ester | 17,000 | 580 |
| 5 | Butyl polyacrylate ester | 14,000 | 370 |
| 6 | Ethyl polyacrylate ester | 21,000 | 690 |
| 7 | 2-ethyl-polyacrylate- | 14,000 | 470 |

TABLE 4-continued

| No. | Sample Agent Tested | Average Molecular Weight (Mw) | Viscosity 100° C. (cp) |
|---|---|---|---|
| | hexyl ester | | |
| 8 | 2-ethyl-polymethacrylate-hexyl ester | 20,000 | 1,308,000 |
| 9 | Polymethacrylic acid lauryl ester | 48,000 | 4,420 |

TABLE 5

| Drawing Test | | Number of Sample Agent Tested 4 | 5 | 6 | 7 | 8 | 9 | Commercial Product |
|---|---|---|---|---|---|---|---|---|
| State of Pipe | Internal Surface | ⊙ | ⊙ | ⊙ | ⊙ | ⊙ | ○ | |
| | External Surface | ⊙ | ⊙ | ⊙ | ⊙ | ⊙ | ⊙ | |
| State of Plug | | ⊙ | ⊙ | ⊙ | ⊙ | ⊙ | ○ | |
| Maximum Drawing Load (ton) | | 6.7 | 6.7 | 6.7 | 6.7 | 6.8 | 6.7 | 6.8 |
| Maximum Plug Thrust (ton) | | 1.0 | 1.1 | 1.2 | 1.0 | 1.3 | 1.2 | 1.3 |

Remarks:
1. Commerical product is G-755B metal working fluid (product name) from Nippon Kosakuyu Co., Ltd. A lubricating oil for drawing, that contains chlorinated paraffin as primary component; viscosity 100° C. (cp) = 30.
2. The test was conducted under the drawing test condition I in Table 13.

TABLE 6

| Drawing Test | | Number of Sample Agent Tested 4 | 5 | 6 | 7 | 8 | 9 | Commercial Product |
|---|---|---|---|---|---|---|---|---|
| State of Pipe | Internal Surface | ○ | ○ | ○ | ⊙ | ⊙ | ⊙ | Δ |
| | External Surface | ⊙ | ⊙ | ⊙ | ⊙ | ⊙ | ○ | |
| State of Plug | | ⊙ | ⊙ | ⊙ | ⊙ | ⊙ | ⊙ | X |
| Maximum Drawing Load (ton) | | 7.0 | 7.0 | 7.1 | 7.1 | 7.2 | 7.0 | 7.3 |
| Maximum Plug Thrust (ton) | | 1.3 | 1.4 | 1.4 | 1.3 | 1.4 | 1.4 | 1.4 |

Remarks:
1. Commercial product is G-755B metal working fluid (product name) from Nippon Kosakuyu Co., Ltd. A lubricating oil for drawing, that contains chlorinated paraffin as primary component; viscosity 100° C. (cp) = 30.
2. The test was conducted under the drawing test condition II in Table 13.

According to Tables 5 and 6, all of the high molecular compounds selected as listed in Table 4 are high in viscosity in comparison with the commercial products. Therefore, the inventors estimated that the single use of them would lower the workability. By the way, in the ordinary operation, unless the kinematic viscosity at 50° C. is 1,000 cst or below, the oil supply becomes difficult to use. Consequently, since 2-ethyl polymethacrylate-hexyl ester of (8) is extremely high in viscosity and thus it was evaluated to be impossible to put to actual use, it was excluded.

Next, a study was conducted by aiming to lower the viscosity without lowering the lubricating performance (burning resistance). As the method to lower the viscosity, a thinning oil that is 150° C. or above in flash point and that is a low viscosity liquid at room temperature was considered. As the thinning oil, generally, the oiliness improver is used. As was mentioned in the beginning, as the oiliness improver, there are fats and oils, saturated or unsaturated fatty acid with ten or more carbons, fatty acid ester, phosphate, alcohol, etc., but those which are liquid with low viscosity at room temperature and which are 150° C. or above in flash point are, for example, (a) refined lard, (b) oleic acid, (c) phosphate, (d) hindered ester, (e) isostearic acid, and (f) $C_{18}$ saturated higher alcohol; and while (g) mineral oil is used as an base oil, it is generally used also as the thinning oil.

The thinning oils of (a) through (g) mentioned above are not unable practically as they are, and their compatability with the above-mentioned components (4), (5), (6), (7) and (9) which are to be compounded with them must be satisfactory. Therefore, all possible combinations between (4), (5), (6), (7) and (9) and (a) through (g) were taken into consideration, and they were compounded at a ratio of 1:1 in % by weight, and the compatability was checked. Thus, the results as shown in Table 7 were obtained.

Then from Table 7, it was determined that (7) and (9) are high in compatibility with respective types of oiliness improvers (a) through (f) as well as with (g) and thus they are suitable for the purposes of this invention, and the range of the compounds to selected was narrowed down to 2-ethyl polyacrylatehexyl ester of (7) and polymethacrylic acid lauryl ester of (9).

The oiliness improvers are not limited to be (a) through (f) mentioned above, but since they are liquids at room temperature and are compatible with the above mentioned polymers, they can be used as the oiliness improver in this invention.

In addition, although the oiliness improver is compounded, its significance is different from that in conventional cases. As shown in Tables 5 and 6, since (7) and (9) show a high burning resistance by themselves, unlike in conventional synthetic lubrications oils, they are not to function as the base oil. The oiliness improver is added as a thinning oil.

TABLE 7

| | Number of Sample Agent Tested 4 | 5 | 6 | 7 | 8 | 9 |
|---|---|---|---|---|---|---|
| Mineral Oil (machine-10) | X | X | X | ○ | — | ○ |
| Refined Lard | X | Δ | X | ○ | — | ○ |
| Oleic Acid | ○ | ○ | X | ○ | — | ○ |
| Phosphate | ○ | ○ | Δ | ○ | — | ○ |
| Hindered Ester | Δ | Δ | Δ | ○ | — | ○ |
| Isostearic Acid | X | Δ | X | ○ | — | ○ |
| $C_{18}$ Saturated Higher Alcohol | X | X | ⊙ | ○ | — | ○ |

Remarks:
○ . . . Completely compatible
Δ . . . Clouded liquid state, tended to separate
X . . . Completed separated into two layers Following the above, with each of 2-ethyl polyacrylatehexyl ester of (7) and polymethacrylic acid lauryl ester of (9), (a) through (g) were compounded, respectively. By using them, many types of test oils were prepared by adjusting the compounding ratio so that the kinematic viscosity at 50° C. becomes about 80, 150, 300, and 600 cst. Then, again, the compatibility and the burning resistance based on the drawing test were checked anew, and the results shown in Table 8, Table 9, Table 10 and Table 11 were obtained.

In Table 8, Table 9, Table 10 and Table 11, three types, that is (a), (b) and (c), are compounded with 2-ethyl polyacrylate-hexyl ester of (7) and polymethacrylic acid lauryl ester of (9), but it does not mean to exclude (d) hindered ester, (e) isostearic acid, and (f) $C_{18}$ saturated higher alcohol. Any oiliness improver that is liquid at room temperature and that is compatible with the above-mentioned polymers may be used.

TABLE 8

| | | (50° C. Kinematic Viscosity about 80 cst) | | | | | | | |
|---|---|---|---|---|---|---|---|---|---|
| NO. OF TEST SAMPLE OIL: | | H1 | H2 | H3 | H4 | R1 | R2 | R3 | R4 |
| % by weight of lubricating components | BASE OIL | | | | | | | | |
| | 7 | 43 | 29 | 38 | 46 | | | | |
| | 9 | | | | | 29 | 16 | 20 | 30 |
| | THINNING OIL | | | | | | | | |
| | h | 57 | | | | 71 | | | |
| | OIL IMPROVER | | | | | | | | |
| | a | | 71 | | | | 84 | | |
| | b | | | 62 | | | | 80 | |
| | c | | | | 54 | | | | 70 |
| Compatibility | | | ○ | ○ | ○ | ○ | ○ | ○ | ○ |
| 50° C. Kinematic Viscosity cst | | 81.3 | 83.2 | 80.4 | 74.6 | 84.4 | 75.7 | 72.9 | 83.5 |
| DRAWING TEST CONDITION II (ton) | | | | | | | | | |
| State of Pipe | Internal Surface | X | ○ | ○ | ○ | X | ○ | ○ | ○ |
| | External Surface | Δ | ○ | ○ | ○ | Δ | ○ | ○ | ○ |
| State of Plug | | X | ○ | ○ | ○ | | ○ | ○ | ○ |
| Maximum Drawing Load | | 7.0 | 6.9 | 6.9 | 6.85 | 7.1 | 6.9 | 6.8 | 6.85 |
| Maximum Plug Thrust | | 1.5 | 1.4 | 1.3 | 1.3 | 1.4 | 1.3 | 1.3 | 1.3 |
| DRAWING TEST CONDITION III (ton) | | | | | | | | | |
| State of Pipe | Internal Surface | XX | ○ | ○ | ○ | XX | ○ | ○ | ○ |
| | External Surface | Δ | ○ | ○ | ○ | Δ | ○ | ○ | ○ |
| State of Plug | | XX | ○ | ○ | ○ | | ○ | ○ | ○ |
| Maximum Drawing Load | | 7.4 | 7.2 | 7.0 | 6.95 | 7.5 | 7.2 | 7.2 | 7.3 |
| Maximum Plug Thrust | | 1.7 | 1.5 | 1.6 | 1.5 | 1.65 | 1.5 | 1.6 | 1.55 |

Remarks:
1. The compatibility is indicated by the same manner as in Table 7.
2. The test was conducted under the Drawing Test Conditions II and III of Table 13.

TABLE 9

| | | (50° C. Kinematic Viscosity about 80 cst) | | | | | | | |
|---|---|---|---|---|---|---|---|---|---|
| NO. OF TEST SAMPLE OIL: | | H5 | H6 | H7 | H8 | R5 | R6 | R7 | R8 |
| % by weight of lubricating components | BASE OIL | | | | | | | | |
| | 7 | 53 | 43 | 51 | 57 | | | | |
| | 9 | | | | | 35 | 25 | 29 | 38 |
| | THINNING OIL | | | | | | | | |
| | h | 46 | | | | 65 | | | |
| | OIL IMPROVER | | | | | | | | |
| | a | | 57 | | | | 75 | | |
| | b | | | 49 | | | | 71 | |
| | c | | | | 43 | | | | 62 |
| Compatibility | | | | | | | | | |
| 50° C. Kinematic Viscosity cst | | 147 | 149 | 155 | 152 | 150 | 151 | 149 | 154 |
| DRAWING TEST CONDITION II (ton) | | | | | | | | | |
| State of Pipe | Internal Surface | Δ | ○ | ⊙ | ⊙ | Δ | ⊙ | ⊙ | ⊙ |
| | External Surface | | ⊙ | ⊙ | ⊙ | ○ | ⊙ | ⊙ | ⊙ |
| State of Plug | | X | ⊙ | ⊙ | ⊙ | X | ⊙ | ⊙ | ⊙ |
| Maximum Drawing Load | | 7.0 | 6.8 | 6.9 | 6.8 | 7.1 | 6.9 | 6.9 | 6.8 |
| Maximum Plug Thrust | | 1.45 | 1.3 | 1.4 | 1.4 | 1.4 | 1.3 | 1.3 | 1.3 |
| DRAWING TEST CONDITION III (ton) | | | | | | | | | |
| State of Pipe | Internal Surface | X | ○ | ○ | ○ | X | ○ | ○ | ○ |
| | External Surface | | ⊙ | ⊙ | ⊙ | ○ | ○ | ⊙ | ⊙ |
| State of Plug | | X | ○ | ⊙ | ⊙ | X | ○ | ⊙ | ⊙ |

TABLE 9-continued

| NO. OF TEST SAMPLE OIL: | H5 | H6 | H7 | H8 | R5 | R6 | R7 | R8 |
|---|---|---|---|---|---|---|---|---|
| (50° C. Kinematic Viscosity about 80 cst) | | | | | | | | |
| Maximum Drawing Load | 7.4 | 7.2 | 7.4 | 7.3 | 7.5 | 7.3 | 7.2 | 7.2 |
| Maximum Plug Thrust | 1.7 | 1.55 | 1.6 | 1.55 | 1.75 | 1.6 | 1.6 | 1.5 |

REMARKS:
1. The compatibility is indicated in the same way as in Table 7.
2. The test was performed by using the drawing test conditions II and III in Table 13.

TABLE 10

| NO. OF TEST SAMPLE OIL: | | H9 | H10 | H11 | H12 | R9 | R10 | R11 | R12 | CONVENTIONAL PRODUCT |
|---|---|---|---|---|---|---|---|---|---|---|
| (Drawing Test) | | | | | | | | | | |
| % by weight of lubricating components | BASE OIL | | | | | | | | | |
| | 7 | 65 | 57 | 62 | 68 | | | | | |
| | 9 | | | | | 43 | 35 | 38 | 46 | |
| | THINNING OIL | | | | | | | | | |
| | h | 35 | | | | 57 | | | | |
| | OIL IMPROVER | | | | | | | | | |
| | a | | 43 | | | | 65 | | | |
| | b | | | 38 | | | | 62 | | |
| | c | | | | 46 | | | | 54 | |
| Compatibility | | ○ | ○ | ○ | ○ | ○ | ○ | ○ | ○ | ○ |
| 50° C. Kinematic Viscosity cst | | 326 | 283 | 298 | 313 | 318 | 292 | 306 | 302 | 290 |
| DRAWING TEST CONDITION II (ton) | | | | | | | | | | |
| State of Pipe | Internal Surface | Δ | ⊙ | ⊙ | ⊙ | Δ | ○ | ○ | ○ | ○ |
| | External Surface | ○ | ⊙ | ⊙ | ⊙ | ○ | ⊙ | ⊙ | ⊙ | ⊙ |
| State of Plug | | ○ | ⊙ | ⊙ | ⊙ | ○ | ⊙ | ⊙ | ⊙ | ○ |
| Maximum Drawing Load | | 7.0 | 6.8 | 6.8 | 6.8 | 7.1 | 6.8 | 6.9 | 6.8 | 7.0 |
| Maximum Plug Thrust | | 1.65 | 1.5 | 1.5 | 1.6 | 1.5 | 1.45 | 1.5 | 1.4 | 1.5 |
| DRAWING TEST CONDITION III (ton) | | | | | | | | | | |
| State of Pipe | Internal Surface | XX | ○ | ○ | ○ | XX | ○ | ○ | ○ | Δ |
| | External Surface | Δ | ○ | ○ | ○ | Δ | ○ | ○ | ○ | ○ |
| State of Plug | | XX | ○ | ○ | ○ | ○ | ○ | ○ | ○ | X |
| Maximum Drawing Load | | 7.4 | 7.2 | 7.0 | 6.95 | 7.5 | 7.2 | 7.2 | 7.3 | 7.4 |
| Maximum Plug Thrust | | 1.7 | 1.5 | 1.6 | 1.5 | 1.65 | 1.5 | 1.6 | 1.55 | 1.65 |

Remarks:
1. The compatibility is indicated in the same way as in Table 7.
2. The test was performed by using the drawing test conditions II and III in Table 13.
3. The conventional product used for comparison is G-755B (product name) from Nippon Kosakuyu Co., Ltd. It is a lubricating oil for drawing, containing chlorinated paraffin as the main component. 100° C. - 30 cp.

TABLE 11

| NO. OF TEST SAMPLE OIL: | | H13 | H14 | H15 | H16 | R13 | R14 | R15 | R16 |
|---|---|---|---|---|---|---|---|---|---|
| (Drawing Test) | | | | | | | | | |
| % by weight of lubricating components | BASE OIL | | | | | | | | |
| | 7 | 78 | 70 | 77 | 80 | | | | |
| | 9 | | | | | 50 | 44 | 48 | 53 |
| | THINNING OIL | | | | | | | | |
| | h | 22 | | | | 50 | | | |
| | OIL IMPROVER | | | | | | | | |
| | a | | 30 | | | | 56 | | |
| | b | | | 23 | | | | 52 | |
| | c | | | | 20 | | | | 47 |
| Compatibility | | | | | | | | | |
| 50° C. Kinematic Viscosity cst | | 603 | 614 | 685 | 611 | 565 | 592 | 605 | 634 |
| DRAWING TEST CONDITION II (ton) | | | | | | | | | |

TABLE 11-continued

| NO. OF TEST SAMPLE OIL: | | (Drawing Test) H13 | H14 | H15 | H16 | R13 | R14 | R15 | R16 |
|---|---|---|---|---|---|---|---|---|---|
| State of Pipe | Internal Surface | Δ | ○ | ⊙ | ⊙ | Δ | ⊙ | ⊙ | ⊙ |
| | External Surface | ○ | ⊙ | ⊙ | ⊙ | | ⊙ | ⊙ | ⊙ |
| State of Plug | | ○ | ⊙ | ⊙ | ⊙ | | ⊙ | ⊙ | ⊙ |
| Maximum Drawing Load | | 7.1 | 6.9 | 6.8 | 6.8 | 7.25 | 6.8 | 6.8 | 6.8 |
| Maximum Plug Thrust | | 1.45 | 1.4 | 1.45 | 1.4 | 1.55 | 1.45 | 1.45 | 1.4 |
| DRAWING TEST CONDITION III (ton) | | | | | | | | | |
| State of Pipe | Internal Surface | X | ⊙ | ⊙ | ⊙ | X | ⊙ | ⊙ | ⊙ |
| | External Surface | ○ | ⊙ | ⊙ | ⊙ | | ⊙ | ⊙ | ⊙ |
| State of Plug | | XX | ○ | ⊙ | ⊙ | XX | ⊙ | ⊙ | ⊙ |
| Maximum Drawing Load | | 7.5 | 7.3 | 7.3 | 7.3 | 7.55 | 7.2 | 7.3 | 7.25 |
| Maximum Plug Thrust | | 1.7 | 1.55 | 1.6 | 1.5 | 1.75 | 1.6 | 1.6 | 1.5 |

Remarks:
1. The compatibility is indicated in the same way as in Table 7.
2. The test was performed by using the drawing test conditions II and III in Table 13.

It was found from Tables 8 through 11 that burning is caused less on the external and internal surfaces of the tested materials (drawn pipes) when the oiliness improver is compounded as the thinning oil, than that caused in the lubrication performance shown by the case where the respective polymers are used as the only component. In particular, those diluted with oleic acid or phosphate are satisfactory in lubricating performance, and also, those with higher viscosity are proportionally higher in performance. In the case of 80 cst, slight burning was observed. The case in which mineral oil was compounded as the thinning oil was unsatisfactory in performance.

Next, the burning resistance was checked for the samples obtained by diluting them with a thinning oil (equal % by weight compounding) prepared by combining not only one type but not less than two types selected from lard, oleic acid and phosphate.

The thinning oils (equal % by weight compounding) were prepared by combining not less than two types selected from lard, oleic acid and phosphate, and the respective thinning oils thus obtained were compounded (also in this case, the compounding ratio was equal to each other among the components in terms of % by weight) with 2-ethyl polyacrylate-hexyl ester or polymethacrylic acid lauryl ester. Also, an adjustment was made for the kinematic viscosity so that it became about 300 cst at 50° C. In this manner, many types of test oils were prepared. Together with the products (lubricants) obtained by using the conventional art, the test oils were tested by the drawing test under the drawing test condition IV in Table 13, and the results shown in Table 12 were obtained. The drawing test condition IV is 45.9% in reduction of area, and this is a processing degree (draft) close to the limit for the drawing of carbon steel pipe, for one time. If the draft is increased even slightly from it, the material becomes ruptured.

From the results shown in Table 12, it was found that the lubricants provided by this invention have a burning resistance almost equivalent to that shown by the conventional lubricants (those obtained by the chemical conversion coatings and by the synthetic coating processing). Also, it was found that when the metal face of the outer surface of the steel pipe after the drawing conducted by using the lubricants according to this invention was compared with such metal surface drawn by using the conventional lubricant, the metal surface resulting from the use of the lubricant according to this invention is cleaner than that resulting from the use of the conventional lubricant.

From the results obtained as mentioned above, it was confirmed that the samples prepared by compounding the thinning oil that is composed of a single component selected from oleic acid, lard and phosphate which are the oiliness improvers, or that is composed of two or more types of components selected from the foregoing oiliness improvers, with either 2-ethyl polyacrylate-hexyl ester or polymethacrylic acid lauryl ester have excellent burning resistance comparable to that shown by lubricants obtained by chemical conversion coatings or resin coatings.

Furthermore, since 2-ethyl polyacrylate-hexyl ester and polymethacrulic acid lauryl ester are compatible with each other, the thinning oil composed of a single component or the combined components selected from oleic acid, lard and phosphate may be compounded with the compound of 2-ethyl polyacrylate-hexyl ester and polymethacrylic acid lauryl ester.

TABLE 12

| No. of Oil Tested | Composition of Thinning Oil | Base Oil | (Drawing Test) State of Pipe Internal Surface | State of Pipe External Surface | State of Plug | Maximum Stretching Load (ton) | Maximum Plug Load (ton) | 50° Kinematic Viscosity cst |
|---|---|---|---|---|---|---|---|---|
| H17 | Oleic Acid & Lard | 7 | ○ | ⊙ | ○ | 7.7 | 2.4 | 310 |
| H18 | Oleic Acid & Phosphate | 7 | ⊙ | ⊙ | ⊙ | 7.6 | 2.2 | 301 |
| H19 | Lard & | 7 | ○ | ⊙ | ○ | 7.8 | 2.35 | 301 |

TABLE 12-continued

| No. of Oil Tested | Composition of Thinning Oil | Base Oil | (Drawing Test) State of Pipe Internal Surface | External Surface | State of Plug | Maximum Stretching Load (ton) | Maximum Plug Load (ton) | 50° Kinematic Viscosity cst |
|---|---|---|---|---|---|---|---|---|
| H20 | Phosphate Oleic Acid | 7 | ○ | ⊙ | ○ | 7.8 | 2.45 | 288 |
| R17 | Lard & Phosphate Oleic Acid & Lard | 9 | ○ | ⊙ | ○ | 7.75 | 2.45 | 297 |
| R18 | Oleic Acid & Phosphate | 9 | ⊙ | ⊙ | ⊙ | 7.6 | 2.2 | 292 |
| R19 | Lard & Phosphate | 9 | ⊙ | ⊙ | ⊙ | 7.65 | 2.3 | 308 |
| R20 | Oleic Acid, Lard & Phosphate | 9 | ○ | ⊙ | ○ | 7.8 | 2.4 | 285 |
| PRIOR ART | Phosphate as base & Sodium Stearate | | ⊙ | ⊙ | ○ | 7.6 | 2.1 | — |
| | Resin Coating Processing | | ⊙ | ⊙ | ⊙ | 7.65 | 2.2 | |

Remarks:
1. The compatibility is indicated in the same way as in Table 7.
2. Base oils (7) and (9) are those in Table 4.
3. Thinning oils (h), (a), (b), (c), (d) are those in Table 8.

TABLE 13

| | (List of Drawing Test Conditions) |
|---|---|
| Sample Matter Tested | Quality: Carbon Steel Pipe for Mechanical Structure 0.2% C (STKM-13C)<br>Master Pipe Dimensions: Outside Diameter 25.4 mm × wall thickness 2.5 mmt<br>Oil Supply: Immersion |

| Condition | Dimensions after drawing (outside diameter × wall thickness) | Reduction in Area | Plug | Drawing Rate |
|---|---|---|---|---|
| I | 19.00 mmϕ × 2.3 mmt | 32.9% | Spherical Plug | 10 m/min |
| II | 19.00 mmϕ × 2.1 mmt | 38.0% | Spherical Plug | 10 m/min |
| III | 19.00 mmϕ × 1.9 mmt | 43.2% | Spherical Plug | 10 m/min |
| IV | 19.00 mmϕ × 1.8 mmt | 45.9% | Spherical Plug | 10 m/min |

As seen in Tables 8 through 11, when the mineral oil is added, the lubricating performance of the polymers is lowered. However, for example, in the area reduction processing for metal sheet, compared with the drawing of steel pipe, the lubricating condition is considerably easier. Therefore, if an extremely low cost mineral oil can be added without causing a significant lowering of the lubricating performance, it is possible to use the mineral oil as a filler (extending agent), thus, it is economical. Accordingly, with respect to the lubricating performance of the polymers in terms of the burning resistance in cold plastic processing, the possibility of mixing mineral oil to make it feasible to carry out cold plastic processing with a burning resistance that is higher than that shown by conventional oily lubricant although it is lower than that shown by the conventional chemical conversion coating lubrication and synthetic resin coating lubrication was investigated.

For the purpose mentioned above, the inventors prepared test oils by further compounding mineral oil, at various ratios, with the oily lubricant obtained by compounding the above mentioned thinning oil with 2-ethyl polyacrylate-hexyl ester. Then, by conducting an area reduction (drawing) test, the relation between the lowering in lubricating performance and the ratio of the mineral oil compounded was checked. The results are shown in Table 14. As is seen in this Table, each test oil has a lubricating performance range best suitable for the area reduction (drawing) processing of metal sheet, that is determined in accordance with the compounding ratio.

TABLE 14

| | | | | (Area Reduction Test) 92 | 93 | 94 | 95 | 96 | 97 | 98 | 99 | 100 |
|---|---|---|---|---|---|---|---|---|---|---|---|---|
| | Blank Diameter mm ϕ | | | | | | | | | | | |
| | Reduction Ratio = blank diameter ÷ punch diameter | | | 2.3 | 2.325 | 2.35 | 2.375 | 2.4 | 2.425 | 2.45 | 2.475 | 2.5 |
| % by weight | Oily Lubricant | Mineral Oil | | | | | | | | | | |
| of | 100 parts | 0 parts | 149 | | | | | ○,○ | ○,○ | ○,○ | X,X | X,X |
| test | 100 parts | 10 parts | 150~ | | | | ○,○ | ○,○ | X,○ | X,X | | |
| oil | 100 parts | 20 parts | 160 | | | | ○,○ | ○,○ | X,X | | | |
| | 100 parts | 40 parts | cst | | | ○,○ | ○,○ | X,X | | | | |
| | 100 parts | 60 parts | | | ○,○ | ○,○ | X,X | | | | | |
| CONVENTIONAL PRODUCT | Commercial Press Oil | | 160 | | | ○,○ | ○,○ | X,X | X,X | | | |
| | Resin Coating Lubrication | | — | | | | | ○,○ | ○,○ | ○,○ | ○,X | X,X |

50° C. kinematic

TABLE 14-continued

| | (Area Reduction Test) | | | | | | | | |
|---|---|---|---|---|---|---|---|---|---|
| Blank Diameter mm ϕ | 92 | 93 | 94 | 95 | 96 | 97 | 98 | 99 | 100 |
| viscosity cst | | | | | | | | | |

A. Remarks:
1. Cylinder drawing (area reduction) test condition
Punch diameter; 40 mm ϕ, shoulder 4.5 mm R
Die diameter; 42.58 mm ϕ, shoulder 9.1 mm R
Sample material tested; spec 0.8 mmt (cold rolled steel sheet)
Drawing rate; 20 M/min
Wrinkle press; 700 kg
2.○ . . . Drawing is succeeded, X . . . Ruptured
3. cst indicates the kinematic viscosity at 50° C.
4. For the product according to this invention, the sample H6 in Table 9 was used.
5. As the thinning oil, the machine oil 220 that is similar to H6 in viscosity was used.
6. As the commercial press oil, No. 640 press machine oil (metal working fluid) produced by Nippon Kosakuyu (50° C. 160 cst, with chlorine, sulfur system extreme pressure additive compounded) was used.
7. For the resin coating lubrication processing, a resin coating type lubricant, commercial name "Lubcoat N-7" from Nippon Kosakuyu, was used.

Finally, for the sample materials for the drawing and area reduction tests using the test oils according to this invention obtained by varying the compounding ratio of the components mentioned above, respectively, the following test was conducted. That is, the sample materials were immersed in an aqueous solution of 3% sodium orthosilicate that was heated to 60° C. The result is that every sample could be freed from grease completely. Also, no discloration or corrosion was caused to the steel material.

As should be apparent from the description given above, the oily lubricant for cold plastic processing of metallic material, that is provided by this invention, has the following effects.

(1) While it is an oily lubricant, it has a burning resistance equivalent to that shown by the chemical conversion coating lubrication and the synthetic resin coating lubrication. Consequently, various types of cold plastic processings in which the quality of the resulting product was assured by the chemical conversion coating lubrication and the synthetic resin coating lubrication can employ the direct oil supply system instead of the above mentioned coating lubricants. Thus, the lubricating treatment becomes simple and less troublesome. As a result, the process becomes simpler than the process using the chemical conversion coating lubrication and the resin coating lubrication, and such direct oil supply system can be applied also to the continuous processes. Furthermore, various types of cold plastic processing products which have been assured of their quality by chemical conversion coating lubrication and synthetic resin coating lubrication are easy to treat for the removal of lubricating oil after processing due to the use of the oily lubricant. Thus, the metal surface becomes cleaner than that of products processed by using chemical conversions coating lubrication or synthetic resin coating lubrication. Also, when lubricating performance can be a little lower, such as in the area of reduction processing for metal sheet, mineral oil can be used as a filler.

(2) As it contains not only extreme pressure additives, but also other materials which are high in reactivity, the metal material does not corrode, thus, the defects of oily lubricants provided by prior art can be eliminated.

We claim:

1. An oily lubricant for cold plastic processing of metallic material comprising:

one or both of the polymers selected from the group consisting of 2-ethyl polyacrylate-hexyl ester having an average molecular weight of 14,000 Mw and polymethacrylic acid lauryl ester having an average molecular weight of 48,000 Mw;

one or more oiliness improver selected from the group consisting of pure lard, phosphate, hindered ester, isostearic acid, or $C_{18}$ saturated higher alcohol, said oiliness improver having a flash point of over 150° C., being in a form of a low viscosity fluid at room temperature, and being compatible with said polymer, said oiliness improver comprising 20 to 75% by weight of a total weight of said polymer and said oiliness improver; and wherein kinematic viscosity of said lubricant at 50° C. is adjusted to 1,000 cst or less.

* * * * *